US007681636B2

(12) United States Patent
Roggeband et al.

(10) Patent No.: US 7,681,636 B2
(45) Date of Patent: Mar. 23, 2010

(54) PIPE EXPANDER

(75) Inventors: Serge Mathieu Roggeband, Rijswijk (NL); Antonius Leonardus Maria Wubben, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 81 days.

(21) Appl. No.: 11/997,857

(22) PCT Filed: Jul. 20, 2006

(86) PCT No.: PCT/EP2006/064449

§ 371 (c)(1),
(2), (4) Date: Feb. 4, 2008

(87) PCT Pub. No.: WO2007/017355

PCT Pub. Date: Feb. 15, 2007

(65) Prior Publication Data

US 2008/0223568 A1 Sep. 18, 2008

(30) Foreign Application Priority Data

Aug. 5, 2005 (EP) ..... 05107253

(51) Int. Cl.
*E21B 23/00* (2006.01)
*E21B 29/00* (2006.01)
*E21B 19/00* (2006.01)

(52) U.S. Cl. ..... 166/207; 166/217; 166/277; 166/380

(58) Field of Classification Search ..... 166/207, 166/208, 217, 277
See application file for complete search history.

(56) References Cited

U.S. PATENT DOCUMENTS

| | | | | |
|---|---|---|---|---|
| 3,191,680 | A * | 6/1965 | Vincent | 166/387 |
| 6,012,523 | A | 1/2000 | Campbell et al. | 166/277 |
| 2003/0150608 | A1 * | 8/2003 | Smith et al. | 166/118 |
| 2004/0216891 | A1 * | 11/2004 | Maguire | 166/380 |
| 2005/0045342 | A1 | 3/2005 | Luke et al. | 166/384 |
| 2005/0103502 | A1 * | 5/2005 | Watson et al. | 166/380 |

FOREIGN PATENT DOCUMENTS

| | | |
|---|---|---|
| WO | WO0026500 | 5/2000 |
| WO | WO03010414 | 2/2003 |
| WO | WO2004079157 | 9/2004 |

* cited by examiner

*Primary Examiner*—Jennifer H Gay
*Assistant Examiner*—Michael Wills, III

(57) ABSTRACT

An expander is provided for radially expanding a tubular element, the expander having an axially forward direction and being provided with thrust means for exerting a thrust force to the expander to move the expander in axially forward direction through the tubular element. The expander comprises an adjustable cone having an expander surface tapering radially inward in the axially forward direction, the adjustable cone being movable between a radially expanded mode and a radially collapsed mode. The expander further comprises adjusting means for moving the adjustable cone from the collapsed mode to the expanded mode by the action of said thrust force exerted to the thrust means.

10 Claims, 3 Drawing Sheets

PIPE EXPANDER

Figure 1:
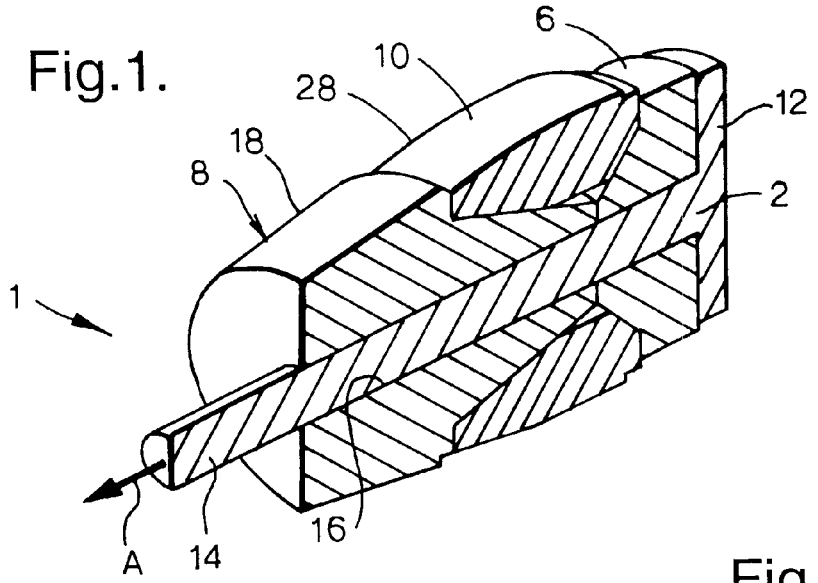

The present application claims priority to Application PCT/EP/2006064449, filed 20 Jul. 2006, which in turn claims priority from EP Application 05107253.6

The present invention relates to an expander for radially expanding a tubular element. Expandable tubular elements find increased application in the construction of wells for the production of oil and gas from an earth formation. In such applications, an expandable tubular element is lowered into the wellbore and subsequently radially expanded to form a structural part of the well, for example a casing, a liner, or a sandscreen. Wellbores typically are drilled in sections whereby after drilling of each section, a further casing or liner is lowered into the newly drilled wellbore section and radially expanded therein. Optionally the expanded casing or liner can be cemented in the wellbore by pumping a layer of cement between the casing, or liner, and the wellbore wall, either before or after the expansion process.

Generally the tubular element is expanded in the wellbore by pumping, pulling or pushing an expander through the tubular element. The expander has an outer surface tapering from a diameter slightly smaller than the inner diameter of the unexpanded tube to a diameter corresponding to the required inner diameter of the tube after expansion. Normally there is sufficient clearance between the unexpanded tubular element and the wellbore wall, allowing the tubular element to be radially expanded without excessive expansion forces. However the wellbore wall may have local irregularities, for example inwardly protruding wall portions, which prevent the tubular element from being fully expanded without excessive expansion forces. Also, obstructions in the form of caved-in wall portions may be present between the tubular element and the wellbore wall, or the wall of tubular element itself may have irregularities, which prevent normal expansion of the tubular element.

It has been experienced that such obstructions and irregularities can lead to a situation whereby the expander becomes blocked in the tubular element thus prohibiting further expansion of the tubular element. It is an object of the invention to provide an improved expander which overcomes the problems of the prior art, and which allows further expansion of the tubular element even if an obstruction is encountered in the wellbore.

In accordance with the invention there is provided an expander for radially expanding a tubular element, the expander having an axially forward direction and being provided with thrust means for exerting a thrust force to the expander to move the expander in axially forward direction through the tubular element, the expander comprising an adjustable cone having an expander surface tapering radially inward in the axially forward direction, the adjustable cone being movable between a radially expanded mode and a radially collapsed mode, the expander further comprising adjusting means for moving the adjustable cone from the collapsed mode to the expanded mode by the action of said thrust force exerted to the thrust means.

With the expander according to the invention it is achieved that the adjustable cone moves radially inward from the expanded mode to the collapsed mode in case an obstruction prevents full expansion of the tubular element. Further, it is an advantage of the expander of the invention that the restoring force required to keep the adjustable cone in the expanded mode, or to move the adjustable cone back to the expanded mode in case an obstruction is encountered, is provided by the thrust force which is required to move the expander through the tubular element. Thus there is no need to subject the expander to a high preload to keep the expander in the expanded mode, or to move the expander back from the collapsed mode to the expanded mode.

It is to be understood that the term "thrust force" refers both to the force directly exerted to the expander to pull, push or pump the expander through the tubular element, and to any reaction force caused by the force directly exerted to the expander, such as the reaction force acting from the tubular element on the expander as a result of the expansion process, or the reaction force between the various components of the expander as a result of the expansion process.

In order to allow the adjustable cone to move between the expanded mode and the collapsed mode, the adjustable cone suitably is formed of a plurality of cone segments wherein, for each pair of adjacent cone segments, a slit extends in radial direction between the cone segments of the pair. The radial slits allow the cone segments to move radially inward and outward while still representing a semi-continuous expansion surface, whereby during such movement the circumferential width of the slits decreases (for radial inward movement) or increases (for radial outward movement). Each slit can be formed to fully separate the cone segments, or to only partially separate the cone segments provided the cone segments still are capable of moving radially inward and outward.

Preferably the adjustable cone is a rear cone, the expander further comprising a front cone having an expander surface tapering radially inward in the axially forward direction and having a largest diameter smaller than the largest diameter of the rear cone.

Adequate restoring force for the rear cone is provided if the front cone is axially movable relative to the thrust means, and wherein the adjusting means is arranged to move the rear cone from the collapsed mode to the expanded mode upon axial movement of the front cone relative to the thrust means.

Suitably the thrust means comprises a support member located at a rear end part of the expander, and wherein the adjusting means is arranged to move the rear cone from the collapsed mode to the expanded mode upon axial movement of the front cone towards the support member.

Figure 2:
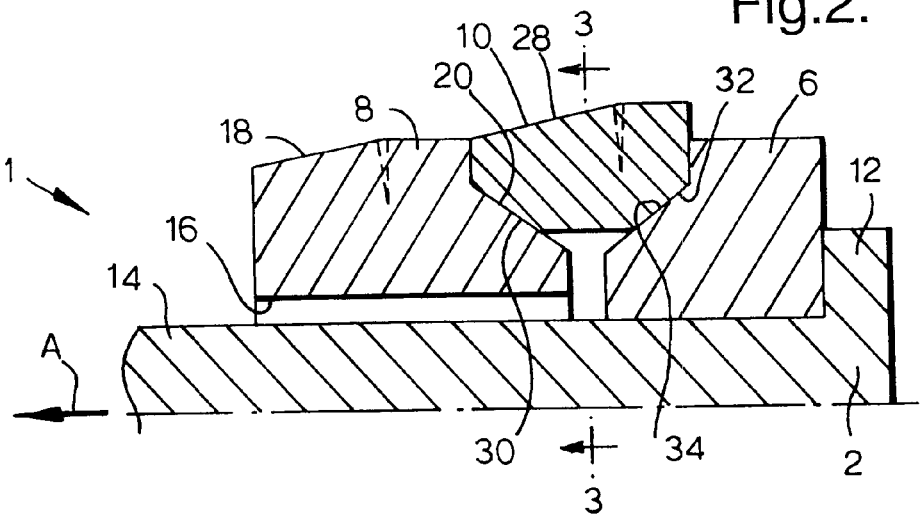
Figure 4:
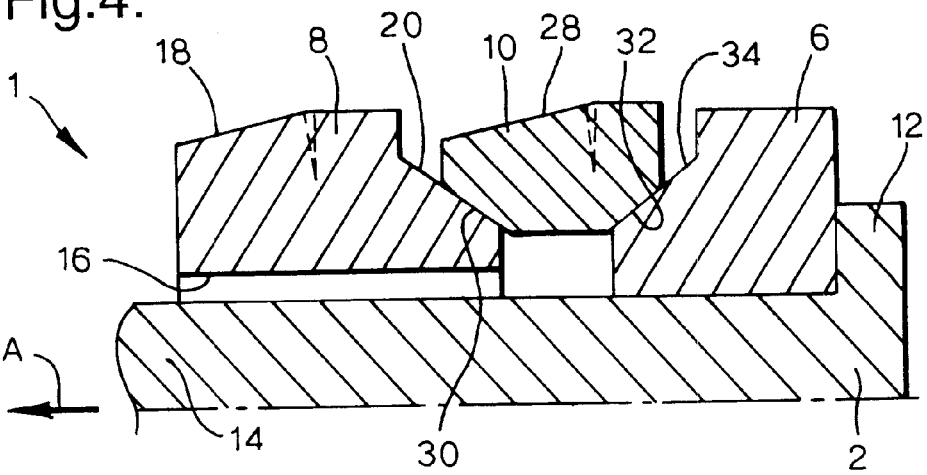
Figure 3:
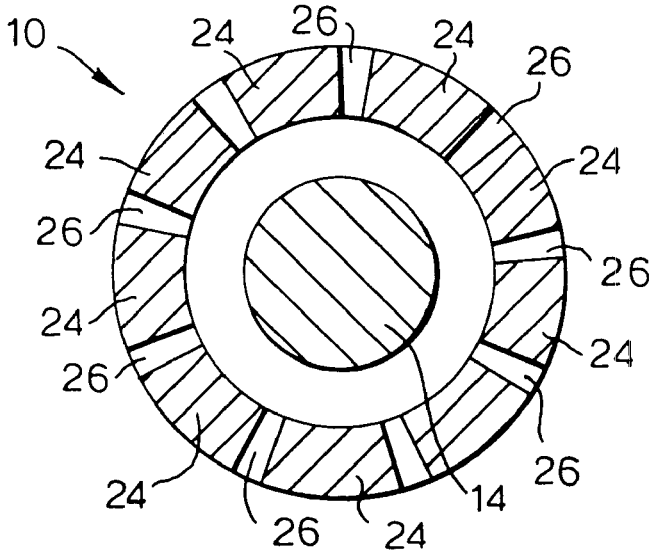
Figure 5:
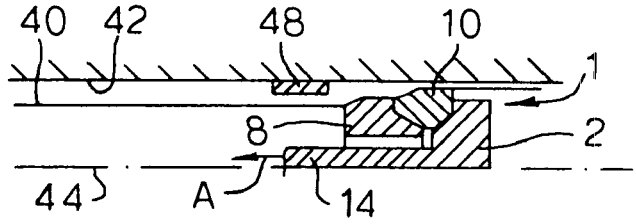
Figure 6:
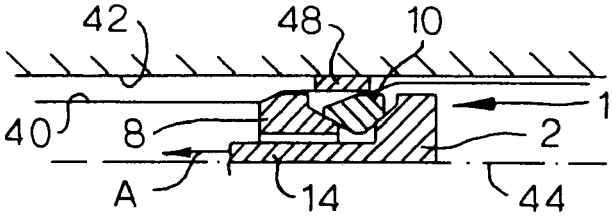
Figure 7:
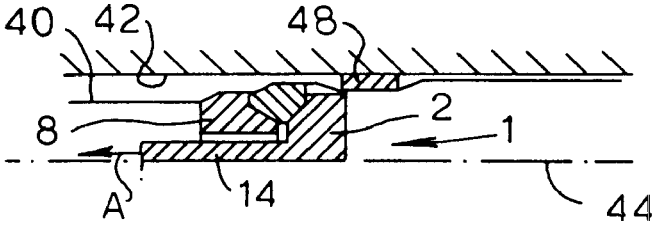
Figure 8:
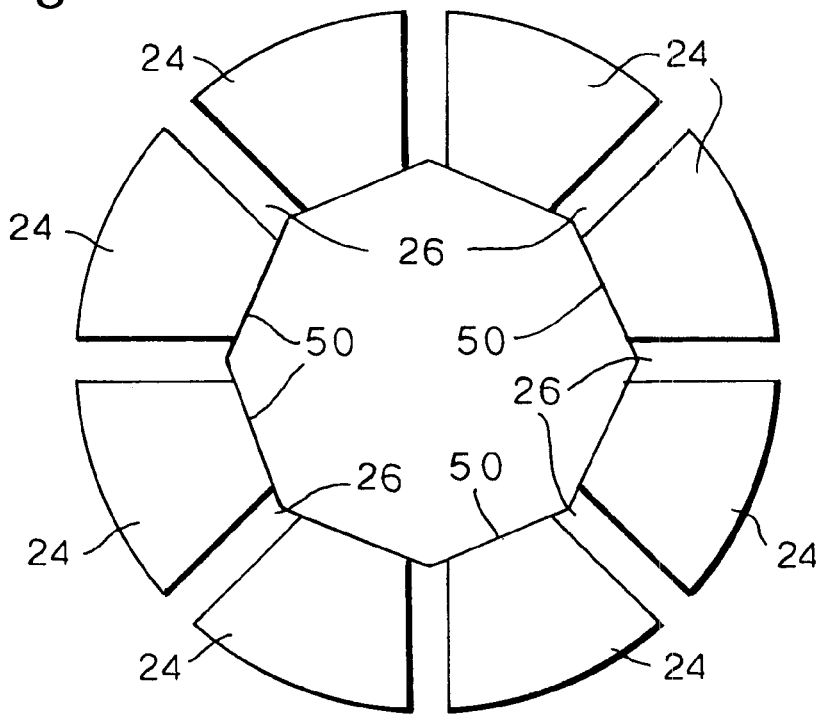
Figure 9:
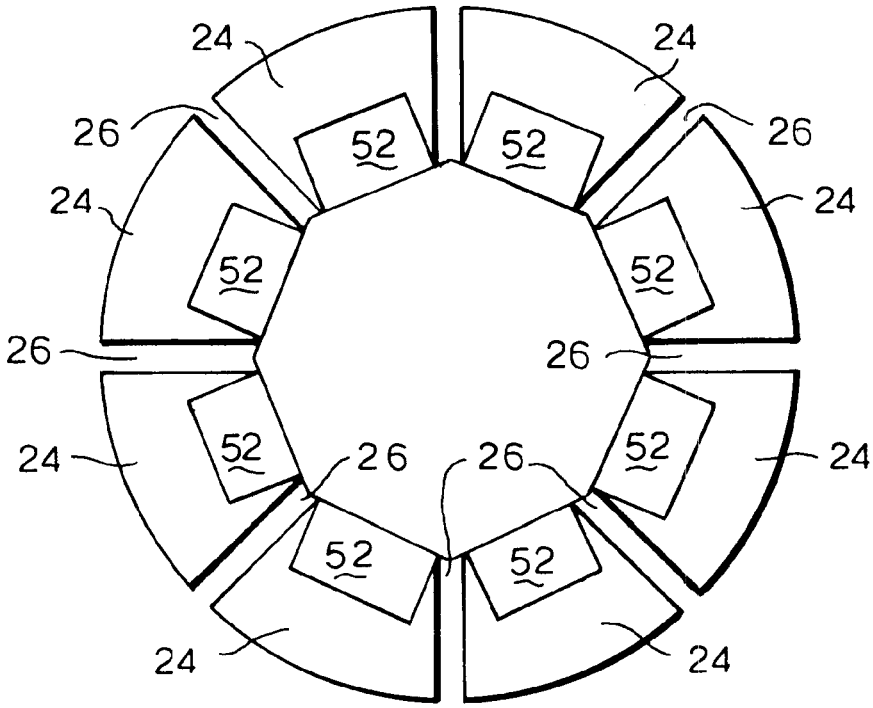

The invention will be described hereinafter in more detail by way of example, with reference to the accompanying drawings in which:

FIG. 1 schematically shows a longitudinal section, in perspective view, of an embodiment of the expander according to the invention;

FIG. 2 schematically shows a longitudinal section of an upper half of the expander of FIG. 1 during a first mode of operation;

FIG. 3 schematically shows cross-section 3-3 of FIG. 2;

FIG. 4 schematically shows a longitudinal section of the upper half of the expander of FIG. 1 during a second mode of operation;

FIG. 5 schematically shows the expander of FIG. 1 during an initial stage of operation;

FIG. 6 schematically shows the expander of FIG. 1 during a subsequent stage of operation;

FIG. 7 schematically shows the expander of FIG. 1 during a further stage of operation;

FIG. 8 schematically shows a cross-section of a portion of a modified embodiment of the expander according to the invention; and FIG. 9 schematically shows a cross-section of a portion of a further modified embodiment of the expander according to the invention.

In the Figures like reference numerals relate to like components.

Referring to FIGS. 1-4 there is shown an expander 1 for radially expanding a tubular element, the expander 1 having an axially forward direction 'A' defining the direction of movement of the expander 1 during expansion of the tubular element. The expander 1 comprises a mandrel 2, a support member 6 fixedly connected to the mandrel 2, a front cone 8 and an adjustable rear cone 10. The mandrel 2 has a rear portion 12 and a shaft 14 extending in forward direction from the rear portion 12, the shaft 14 being provided with a connector (not shown) for connection of the shaft 14 to a pulling string (not shown).

The front cone 8 has a longitudinal bore 16 through which the shaft 14 extends in a manner allowing the front cone 8 to slide in axial direction along the shaft 14. The front cone 8 has an outer surface including a frustoconical front surface portion 18 tapering radially inward in the forward direction 'A', and a recessed rear surface portion 20 tapering radially inward in the direction opposite to direction 'A'. The rear surface portion 20 is somewhat recessed relative to the frustoconical front surface portion 18.

The rear cone 10 is formed of a plurality of cone segments 24 (FIG. 3) circumferentially spaced relative to each other whereby a radial slit 26 extends between the cone segments 24 of each pair of adjacent cone segments. The cone segments 24 are held together by any suitable means, for example a circumferential spring (not shown), which allows the cone segments 24 to move between a radially outward position defining an expanded mode of the rear cone (FIG. 2), and a radially inward position defining a collapsed mode of the rear cone (FIG. 4). The rear cone 10, when in the expanded mode, has a largest diameter larger than the largest diameter of the front cone 8.

The rear cone 10 has a frustoconical outer surface 28 tapering radially inward in the forward direction 'A'. Further, the rear cone 10 has an inner surface portion 30 at the front end thereof, said inner surface portion 30 tapering radially outward in the forward direction 'A', and an inner surface portion 32 at the rear end thereof, the inner surface portion 32 tapering radially inward in the forward 'A'.

The support member 6, which is positioned between the rear portion 12 of the mandrel 2 and the rear cone 10, comprises a recessed outer surface 34 tapering radially inward in the forward direction 'A'.

The taper angle of the front inner surface portion 30 of the rear cone 10 is equal to the taper angle of the rear surface portion 20 of the front cone 8. In similar manner, the taper angle of the rear inner surface portion 32 of the rear cone 10 is equal to the taper angle of the outer surface 34 of the support member 6.

Thus, upon movement of the rear cone 10 from the expanded mode to the collapsed mode, the front inner surface portion 30 of the rear cone 10 slides along the rear surface portion 20 of the front cone 8 thereby sliding the front cone 8 along the shaft 14 in forward relative to the rear cone 10. Simultaneously the rear inner surface portion 32 of the rear cone 10 slides along the outer surface 34 of the support member 6 thereby moving the rear cone 10 forward relative to the mandrel 2 and enhancing the forward sliding movement of the front cone 8 along the shaft 14.

Reference is further made to FIGS. 5-7 showing the expander 1 in longitudinal section, during different stages of expansion of a tubular element 40 extending into a wellbore 42 formed in an earth formation. For ease of reference only the upper half of the expander is shown. Reference sign 44 indicates the central longitudinal axis of the tubular element 40.

During an initial stage of normal operation (FIG. 5) the expander 1 is pulled in forward direction 'A' through the tubular element 40 using a pulling string (not shown) connected to the shaft 14 of the mandrel 2, whereby the rear cone 10 is in the expanded mode. The front cone 8 expands the tubular element 40 to a first diameter, and the rear cone 10, being in the expanded mode, expands the tubular element 40 from the first diameter to a second diameter larger than the first diameter. The front cone 8 is subjected to axial reaction forces biasing the front cone 8 against the rear cone 10. The axial reaction forces cause the rear cone 10 to become compressed between the front cone 8 and the support member 6, so that the cone segments 24 slide up the respective frustoconical surfaces 20, 34 of the front cone 8 and the support member 6 thereby maintaining the rear cone 10 in the expanded mode.

During a subsequent stage of normal operation (FIG. 6) an obstruction 48, for example in the form of a borehole restriction, or a connection of the tubular element, may be present in the wellbore 42. Upon passing along the obstruction 48, the front cone 8 expands the tubular element 40 to the first diameter. However the obstruction 48 prevents further expansion by the rear cone 10. Thus upon continued movement of the expander 1 through the tubular element 40, the axial reaction force acting on the front cone 8 is insufficient to maintain the rear cone 10 in the expanded mode, and the cone segments 24 of the rear cone 10 are biased radially inward by virtue of high radial reaction forces exerted from the tubular element 40 to the rear cone 10 at the level of the obstruction 48. Inward movement of the segments 24 stops when the diameter of the rear cone 10 is reduced sufficiently to allow the expander 1 to expand the tubular element 40 inside the obstruction 48. As described hereinbefore, such radial inward movement of the rear cone 10 from the expanded mode to the collapsed modes causes the front cone 8 to move axially forward relative to the mandrel 2. The front cone 8 thereby temporarily expands the tubular element 40 at an increased speed. It will be understood that the axial reaction force acting on the front cone 8 tends to bias the rear cone 10 back to the expanded mode. The expander 1, with the rear cone 8 in the collapsed mode, passes along the obstruction 48 whereby the portion of the tubular element 40 opposite the obstruction 48 is expanded to a reduced diameter relative to the expansion diameter of the remainder portion of the tubular element 40.

During a further stage of normal operation (FIG. 7), the expander 1 has passed along the obstruction 48. The axial reaction force acting on the front cone 8 pushes the rear cone 10 in backward direction, so that the cone segments 24 slide up the respective tapering surfaces 20, 34 of the front cone 8 and the support member 6 thereby moving the rear cone 10 back to the expanded mode. The rear cone 10 then again expands the tubular element 40 from the first diameter to the second diameter.

Referring further to FIG. 8, there is shown a cross-section of a modified rear cone having cone segments 24 with flat tapering inner surfaces 50, as opposed to the rounded tapering inner surfaces 30, 32 of the rear cone 10 of FIGS. 1-7. The corresponding contact surfaces of the front cone 8 and the support member 6 are also modified in that these are also flat.

Referring further to FIG. 9, there is shown a cross-section of a further modified rear cone having cone segments 24 provided with rollers 52 at the flat tapering inner surfaces. The rollers further reduce friction and ensure smooth rolling of the cone segments 24 along the respective tapering surfaces 20, 34 of the front cone 8 and the support member 6.

Instead of the expander being pulled through the tubular element, the expander can be pushed or pumped through the tubular element. Further, it is preferred that suitable friction-reducing means, such as grease or a low-friction coating is provided between the contact surfaces of the front cone and the rear cone, and between the contact surfaces between the rear cone and the support member. Also roller elements can be positioned between the respective contact surfaces to reduce friction.

In order to ensure that the cone segments remain uniformly spaced in the circumferential direction, the front cone and the cone segments of the rear cone can be provided with cooperating guide means to prevent relative movement in circumferential direction between the front cone and the cone segments. Similarly the support member and the cone segments of the rear cone can be provided with cooperating guide means to prevent relative movement in circumferential direction between the support member and the cone segments. For example, the guide means can be provided as a groove at one of the contact surfaces and a corresponding pin or similar member at the other contact surface.

In order to provide increased restoring force capacity to the front cone and the rear cone, the front cone suitably is provided with an additional restoring means such as a hydraulic piston or a spring biasing the front cone in backward direction relative to the mandrel.

In the foregoing description it has been specified that during operation the rear cone moves from an expanded mode to a collapsed mode and vice versa. It is to be understood that the term "collapsed mode" indicates a situation whereby the maximum outer diameter of the rear cone is reduced relative to the maximum outer diameter of the rear cone when in the expanded mode. Thus, the expander is capable of expanding the tubular element to a continuously varying expansion diameter, depending on the size and the resilience of the various obstructions met. For example if the tubular element is a liner that is expanded against an existing casing in the wellbore to form a clad, the maximum diameter to which the liner can be expanded depends on the local variations of the inner diameter of the existing casing. In such application, the expander of the invention is capable of expanding the liner to a continuously varying diameter compliant with the diameter of the existing casing.

In light of the foregoing it will be understood that the expander according to the invention is capable of expanding a tubular element in a manner whereby the expander complies with irregularities or obstructions present in the tubular element or the surrounding formation. The risk of the expander becoming stuck in the tubular element thereby has been greatly reduced.

The invention claimed is:

1. An expander for radially expanding a tubular element, the expander having an axially forward direction and being provided with thrust means for exerting a thrust force to the expander to move the expander in axially forward direction through the tubular element, the expander comprising:

an adjustable rear cone having an expander surface tapering radially inward in the axially forward direction, the adjustable cone being movable between a radially expanded mode and a radially collapsed mode;

adjusting means for moving the adjustable cone from the collapsed mode to the expanded mode by the action of said thrust force exerted by the thrust means; and a front cone positioned axially forward of the rear cone and axially moveable relative to the thrust means, said front cone having an expander surface that tapers radially inward in the axially forward direction, a rear surface that tapers radially inward in a direction opposite to the axially forward direction, and a largest diameter smaller than the largest diameter of the rear cone.

2. The expander of claim 1 wherein the adjusting means is arranged to move the rear cone from the collapsed mode to the expanded mode upon axial movement of the front cone toward the support member.

3. The expander of claim 1, wherein the thrust means comprises a support member located at a rear end part of the expander.

4. The expander of claim 3, wherein the rear cone is arranged between the front cone and the support member.

5. The expander of claim 3, wherein the adjusting means comprises a primary pair of cooperating contact surfaces including a first contact surface provided on the front cone and a second contact surface provided on the rear cone, at least one of said first and second contact surfaces tapering to a smaller diameter in a direction opposite to the axially forward direction.

6. The expander of claim 3, wherein said first and second contact surfaces have substantially equal taper angles.

7. The expander of claim 3 wherein the adjusting means comprises a secondary pair of cooperating contact surfaces including a third contact surface provided on the rear cone and a fourth contact surface provided on the support member, at least one of said third and fourth contact surfaces tapering to a smaller diameter in the axially forward direction.

8. The expander of claim 7, wherein said third and fourth contact surfaces have substantially equal taper angles.

9. The expander of claim 1, wherein the thrust means comprises a mandrel having a shaft extending in axially forward direction, and wherein the front cone and the rear cone are slidably mounted on said shaft.

10. The expander of claim 1, wherein the adjustable cone is formed of a plurality of cone segments, and wherein, for each pair of adjacent cone segments, a slit extends in radial direction between the cone segments of the pair.

* * * * *